United States Patent [19]

Ohata

[11] 4,083,335

[45] Apr. 11, 1978

[54] APPARATUS FOR CONTROLLING THE IGNITION TIMING OF AN INTERNAL COMBUSTION ENGINE

[75] Inventor: Akira Ohata, Susono, Japan

[73] Assignee: Toyota Jidosha Kogyo Kabushiki Kaisha, Toyota, Japan

[21] Appl. No.: 725,575

[22] Filed: Sep. 22, 1976

[30] Foreign Application Priority Data

May 25, 1976 Japan ..... 51-059576

[51] Int. Cl.[2] ..... F02P 5/10

[52] U.S. Cl. ..... 123/117 A; 60/285

[58] Field of Search ..... 123/117 A; 60/281, 285

[56] References Cited

U.S. PATENT DOCUMENTS

| | | | |
|---|---|---|---|
| 3,905,342 | 9/1975 | Kobayashi et al. | 123/117 A |
| 3,935,843 | 2/1976 | Ludwig | 123/117 A |
| 3,955,364 | 5/1976 | Lewis | 123/117 A |
| 3,978,831 | 9/1976 | Yoshikawa | 123/117 A |
| 3,994,269 | 11/1976 | Takaoka et al. | 123/117 A |
| 4,008,697 | 2/1977 | Konno | 123/117 A |

*Primary Examiner*—Charles J. Myhre
*Assistant Examiner*—Parshotam S. Lall
*Attorney, Agent, or Firm*—Stevens, Davis, Miller & Mosher

[57] ABSTRACT

An apparatus for controlling the vacuum ignition timing of an internal combustion engine provided with an exhaust gas recirculation system is disclosed. The apparatus comprises a vacuum advancer having at least one diaphragm therein which forms a chamber on a side of the diaphragm. The chamber is connected to a port in the carburetor for controlling the vacuum ignition timing of the engine by the carburetor vacuum during the exhaust gas recirculation operation. The apparatus further comprises means for preventing the ignition timing from being too advanced when the engine is operating at a high rotational speed. As a result, the required ignition timing during such operation is obtained.

4 Claims, 2 Drawing Figures

PA
PB
PC
PD
86(S1)
88(S2)
Q
P

APPARATUS FOR CONTROLLING THE IGNITION TIMING OF AN INTERNAL COMBUSTION ENGINE

FIELD OF THE INVENTION

The present invention relates to an apparatus for controlling the ignition timing of an internal combustion engine provided with an exhaust gas recirculation (EGR) system.

BACKGROUND OF THE INVENTION

It is well known that EGR operation in an internal combustion engine, which is provided to decrease the amount of nitrogen oxides ($NO_x$) in the engine exhaust, causes inferior flame propagation velocity in the combustion chamber of the engine. Therefore, it is necessary to advance the ignition timing during EGR operation in order to obtain the ignition timing required for maximum output power and maximum fuel comsumption efficiency. In this case it is necessary to advance the ignition timing in accordance with the "degree of EGR" (the ratio of the amount of the exhaust gas to be recirculated, to the amount of total gas supplied to the combustion chamber of the engine).

There has already been provided an apparatus for controlling the ignition timing of an internal combustion engine provided with an EGR system that comprises a vacuum advancer having at least one vacuum advance control diaphragm connected to the vacuum advance shaft of the distributor. A vacuum advance control chamber is formed on a side of the diaphragm remote from the distributor, and is connected to a port to which a flow control chamber of an exhaust gas recirculation valve (EGR valve) of the EGR system is also connected. In this known apparatus the ignition timing during EGR operation, in which a vacuum signal in said port is transmitted to the flow control chamber of the EGR valve for operating the valve, is advanced by said vacuum signal which is also transmitted to said vacuum advance control chamber of the vacuum advancer.

However, this known apparatus has the disadvantage that the ignition timing is too advanced when the engine is operating at a high rotational speed and, therefore, maximum output power and maximum fuel comsumption efficiency are not obtained. This is because: on the one hand, the degree of EGR is not constant with respect to the rotational speed of the engine (the higher the rotational speed, the lower the degree of EGR), and; on the other hand, the level of vacuum in the vacuum advance control chamber of the vacuum advancer is not substantially changed with respect to the rotational speed of the engine. Thus, the vacuum advance control chamber has too large a vacuum when the engine is operating at a high rotational speed. As a result, the vacuum advance shaft of the vacuum advancer is moved so that the ignition timing is too advanced during said operation with respect to the required ignition timing and, thus, the required ignition timing is not obtained.

SUMMARY OF THE INVENTION

An object of the present invention is to provide an apparatus for controlling the ignition timing of an internal combustion engine provided with an exhaust gas recirculation system, which prevents the ignition timing during high rotational speed operation of the engine from being too advanced for obtaining the required ignition timing in said operation.

Another object of the present invention is to provide an apparatus for controlling the ignition timing of an internal combustion engine provided with an EGR system, which allows a maximum output power and maximum fuel consumption efficiency to be obtained.

According to the invention an apparatus is provided for controlling the ignition timing of an internal combustion engine provided with an exhaust gas recirculation system, which apparatus comprises a vacuum advancer having a casing provided therein with at least one vacuum advance control diaphragm connected to the advance shaft of the distributor.

At least one vacuum advance control chamber which is formed on a side of said diaphragm is connected via a pipe to a vacuum advance port formed in the engine intake system for opening said vacuum advance control chamber to the engine vacuum. This causes the vacuum advance shaft to be displaced in an axial direction of the shaft so that the ignition timing of the distributor is advanced in accordance with the engine vacuum level during the exhaust gas recirculation operation by the exhaust gas recirculation system. Said apparatus further comprises a pipe means communicating a port formed in the intake system of the engine with a vacuum compensation chamber formed on another side of said diaphragm of the vacuum advancer opposite to said vacuum advance control chamber, and means connected to said pipe means for controlling the vacuum level of said vacuum advance compensation chamber. This arrangement prevents the advance shaft of the distributor from being moved too far in said axial direction when the engine is operating at a high rotational speed, so that ignition timing during such operation will be delayed. As a result the required ignition timing is obtained during high rotational speed operation of the engine.

DESCRIPTION OF THE EMBODIMENT

Figures 1, 2:
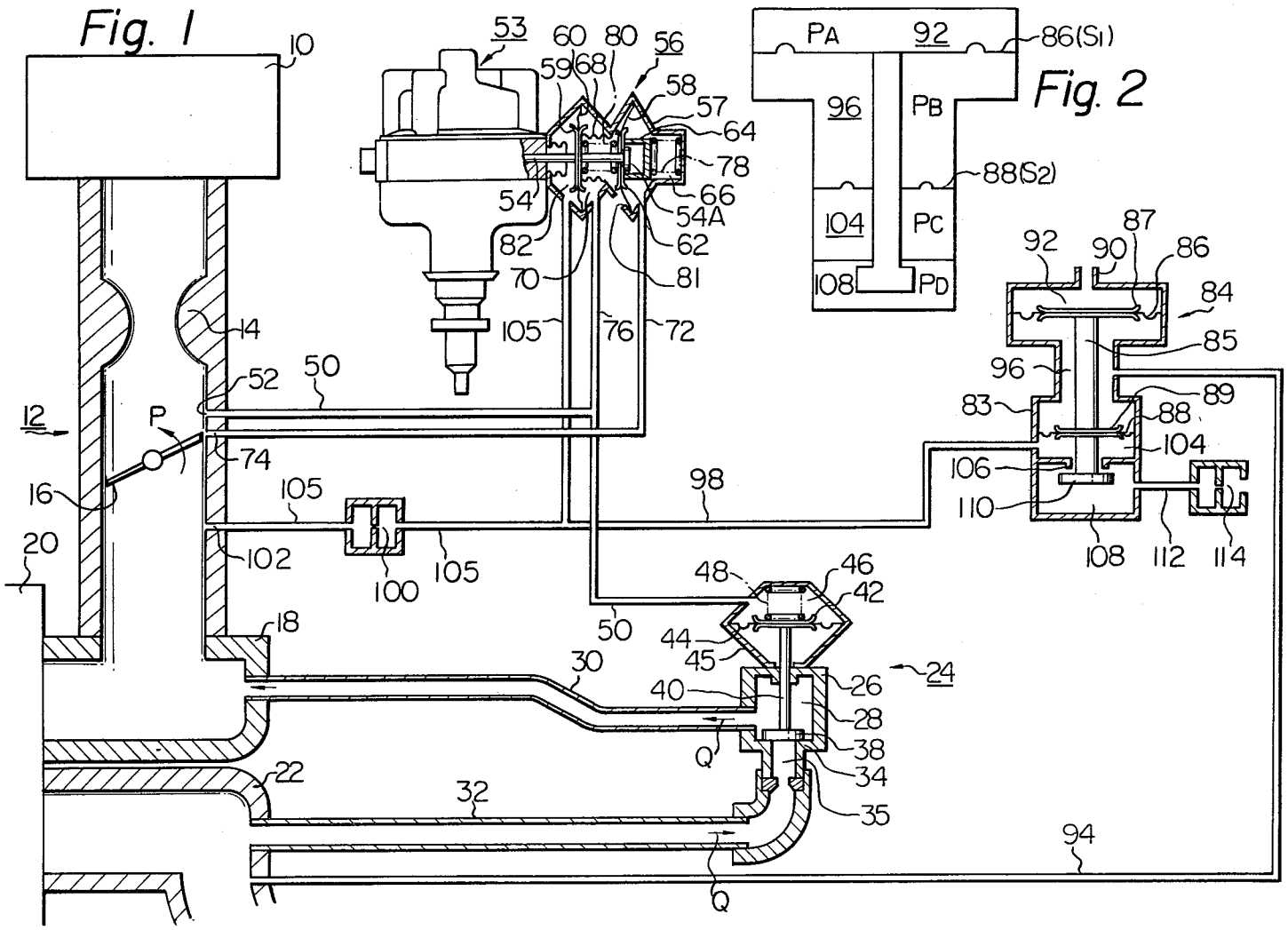
FIG. 1 shows an apparatus for controlling the ignition timing of the internal combustion engine provided with an EGR system, according to the invention.
FIG. 2 shows a diagrammatic representation of a vacuum control valve in FIG. 1, and is used for illustrating the operation of the valve.

Referring to the drawings, an internal combustion engine has an air cleaner 10 which is connected to a carburetor 12. The carburetor has a venturi 14 and a throttle valve 16 located downstream from the venturi 14. The carburetor 12 is connected, through an intake manifold 18, to an engine body 20 to supply an air-fuel mixture to combustion chambers (not shown) formed in the engine body 20.

The engine is provided with an exhaust gas recirculation system having an exhaust gas recirculation valve (EGR valve) 24. The EGR valve 24 includes a body 26 which provides a chamber 28 therein. The chamber 28 is connected, through an EGR pipe 30, to the intake manifold 18 and is connected, through another EGR pipe 32, to an exhaust manifold 22 of the engine, so as to recirculate a part of the exhaust gas from the exhaust manifold 22 to the intake manifold 18 as shown by arrows Q. A valve seat 34 defines a passage 35 which connects the pipes 30 and 32 through the chamber 28. The passage 35 is opened or closed by a valve member 38 which is operated by a flow control diaphragm 44.

The diaphragm 44 is arranged across the interior of a casing 45 secured to the body 26. A flow control chamber 46 is formed on one side of the diaphragm 44 in the casing 45. The diaphragm 44 is mechanically connected to the valve member 38 via a rod 40 which is slidably supported on the body 26. The upper end of the rod 40 is secured to the diaphragm 44 by a pair of plates 42 and the lower end of the rod 40 is integrally formed with the valve member 38. A coil spring 48, which arranged in the flow control chamber 46, urges the diaphragm 44 downwardly so that the valve member 38 closes against the valve seat 34. The chamber 46 communicates with a so-called EGR port 52 in the carburetor 12 by way of a vacuum tube 50 to transmit a vacuum signal in the carburetor 12 to the flow control chamber 46. The EGR port 52 is located upstream from the throttle valve 16 which is shown in it's closed position in the drawing.

The EGR valve 24 does not open to start EGR operation when the engine is in its idle condition. In the idle condition, the throttle valve is located in the fully closed position shown in FIG. 1, in which the port 52 is located upstream from the throttle valve. Therefore, when the engine is idling the control chamber 46 of the EGR valve 24 is opened to the atmosphere through the tube 50, so that the spring 48 urges the diaphragm 44 downwardly to cause the valve member 38 to rest on the valve seat 34. As a result, the exhaust gas from the exhaust manifold 22 is not directed towards the intake manifold 18.

The EGR valve 24 is opened to start EGR operation when the throttle valve 16 is so opened in the direction of an arrow P that the throttle valve 16 is located upstream from the EGR port 52. In this condition of the throttle valve, the control chamber 46 of the EGR valve 24 is opened to the carburetor 12 downstream from the throttle valve 16 so that a vacuum signal is transmitted from the port 52 to the chamber 46. Because of this, the diaphragm 44 is displaced upwardly against the set force of the spring 46 to cause the valve member 38 to be detached from the valve seat 34. This results in the exhaust gas being recirculated from the exhaust manifold 22 to the intake manifold 18 via the EGR pipes 30 and 32, as shown by the arrows Q, thereby causing emission of $NO_x$ components to be reduced.

The internal combustion engine further includes a distributor 53 having an advance shaft 54 connected to a breaker plate, not shown, for controlling the vacuum ignition timing of the engine. As the shaft 54 is moved to the right hand direction of FIG. 1 the ignition timing is advanced.

The apparatus for controlling the ignition timing of the internal combustion engine includes a vacuum advancer 56 connected to the advance shaft 54 to move the shaft 54 in response to vacuum pressure in the carburetor 12. The vacuum advancer 56 is formed, in this embodiment, as a double diaphragm mechanism having two diaphragms 58 and 60 arranged across a casing 57 of the advancer 56, which is secured to a side wall of the distributor 53. The vacuum advance control diaphragm 60 is secured to the shaft 54 remote from the free end thereof by a pair of plates 59. The other vacuum advance control diaphragm 58 is sandwiched between a pair of plates 62, having holes through which the advance shaft 54 freely passes. A flange portion 54A is formed on the free end of the shaft 54. A cup member 64 which covers the flange portion 54A is carried by the one of plates 62. A spring 78 is arranged in a first vacuum advance control chamber 66 which is formed in the casing 57 between the diaphragm 58 and the end of the casing 57, the spring 78 acting between the end of the casing 57 and the member 64. The spring 78 urges the cup 64 and, hence, the diaphragm 58, towards the distributor 53. A bellows member 68 is arranged between the inner surface of the casing 57 and the surface of one of the plates 59, so as to form a second vacuum advance control chamber 70 between the bellows members 68 and the diaphragm 60. Another spring 80 is arranged between the plates 59 and 62. A vent hole 81 is formed in the casing 57 between the diaphragm 58 and the bellows 68 for enabling each of the diaphragms 58 and 60 to be moved independently.

The first vacuum advance control chamber 66 of the vacuum advancer 56 is connected, through a tube 72, to a port 74 in the carburetor. This port 74 is located downstream from the throttle valve 16 when the valve is in its closed postion as shown in FIG. 1. The second vacuum advance control chamber 70 of the vacuum advancer 56 is connected, through a tube 76 to the tube 50 which communicates the EGR port 52 with the flow control chamber 46 of the EGR valve.

The first vacuum advance control diaphragm 58 of the vacuum advancer 56 controls the ignition timing of the engine during its idling operation. In this idling operation, since the first vacuum advance control chamber 66 is opened to the carburetor 12 downstream from the throttle valve (closed as shown in FIG. 1) via the tube 72 and the port 74, the diaphragm 58 is displaced toward the end of the casing 57 away from the distributor 53 against the spring 78 by the carburetor vacuum formed downstream from the throttle valve. By the displacement of the diaphragm 52 in the right hand direction of FIG. 1, the vacuum advance shaft 54 is also displaced in the same direction, because the holes in the plates 57 are smaller than the flange portion 54A of the shaft. Thus, the distributor 53 advances the ignition timing of the engine to obtain the reguired ignition timing of the engine in the idling condition.

The second vacuum advance control diaphragm 60 controls the ignition timing of the engine during EGR operation. In this EGR operation, since the second vacuum advance control chamber 70 is opened to the carburetor 12 downstream from the throttle valve 16 (which is, now, opened in the direction of the arrow P for EGR operation) via the tubes 76 and 50 and the EGR port 52, the diaphragm 60 is displaced towards the end of the casing 57 away from the distributor 53 against the spring 80 by the carburetor vacuum formed in the carburetor downstream from the throttle valve 16. Consequently the flange portion 54A of the advance shaft 54 moves further towards the end of the casing 57 within the cup member 64. This displacement of the diaphragm 60 in the right hand direction of FIG. 1 does not cause any movement of the first diaphragm 58 which is already displaced by the vacuum at the port 74. As a result the ignition timing of the EGR operation is further advanced in accordance with the sum of the vacuum pressures at the ports 52 and 74, in order to obtain the required ignition timing during EGR operation.

The above illustrated construction and operation are substantially the same when compared with the prior art. However, in the prior art the disadvantage is inevitable that, when the engine is operating at a high rotational speed, the ignition timing of the engine is too advanced with respect to the required ignition timing during such operation. This is bacause: on the one hand, the degree of EGR is decreased when the engine rotational speed is increased, and; on the other hand, the vacuum level in the control chamber 70 is not substantially changed with respect to the engine rotational speed. In other words, the vacuum level in the vacuum advance control chamber 70 is too large during the time the engine is operating at a high rotational speed and, therefore, the ignition timing in this operation is too advanced with respect to the required ignition timing. Therefore, it is required to compensate the vacuum level in the chamber 70 when the engine is operating at a high rotational speed.

According to the present invention, to overcome the above-mentioned disadvantage of the prior art, a vacuum compensation chamber 82 is formed on a side of the second diaphragm 60 opposite to the chamber 70. A vacuum signal is transmitted to the chamber 82 when the engine is operating at a high rotational speed. The signal is of such level, that the diaphragm 60 is displaced towards the distributor 53 away from the end of the casing 57. As a result the ignition timing, during said high rotational speed operation of the engine, is delayed to obtain the required ignition timing. To this end a vacuum control valve 84 is provided, which operates to produce a vacuum pressure of a level which is increased in accordance with the exhaust gas pressure in the exhaust manifold 22. Because the exhaust gas pressure corresponds, substantially to the rotational speed of the engine, as is known by those who are skilled in this field, it is possible to obtain a vacuum pressure of a level which is increased in accordance with the engine rotational speed.

The vacuum control valve 84 has a casing 83 provided therein with a first and a second vacuum control diaphragm 86 and 88 of different diameters. These diaphragms are arranged across the interior of the casing 83 parallel to each other. The diaphragm 86 and the diaphragm 88 are secured to a common rod 85 by means of plates 57 and plates 89, respectively. A first chamber 92, which is opened to the atmosphere through a hole 90 formed in the casing 83, is formed on the upper side of the diaphragm 86. A second chamber 96 is formed between the facing sides of the diaphragms 86 and 88. A valve seat 106 is provided in the casing 83 beneath the lower side of the diaphragm 88. A third chamber 104 is formed between the diaphragm 88 and the valve seat 106. A fourth chamber 108, which communicates with the third chamber 104 through a valve member 110 connected to the lower end of the rod 85, is formed on the lower side of the valve seat 106. The second chamber 96 is connected to the exhaust manifold 22 via a tube 94.

The ignition timing compensation chamber 82 is connected to a port 102 formed in the carburetor 12 downstream from the throttle valve 16 via a tube 105, to which the third chamber 104 of the valve 84 is connected. On the tube 105 there is provided an orifice 100 for opening the carburetor vacuum to the chamber 104 at a controlled rate. The fourth chamber 108 is opened to the atmosphere through a tube 112 on which an orifice 114 is provided for opening the chamber 104 to the atmosphere at a controlled rate.

The vacuum control valve 84 operates to obtain a vacuum in the chamber 104 of a level which increases with the exhaust gas pressure in the exhaust manifold 22, by introducing atmospheric air from the fourth chamber 108, via the orifice 114, into the third chamber 104 opened to the carburetor vacuum via the orifice 100. The introducing operation of the air from the orifice 114 is controlled by the valve member 110 which is moved with respect to the valve seat in accordance with forces applied to the diaphragms 86 and 88 due to the exhaust gas pressure in the exhaust manifold 22. This operation of the vacuum control valve 84 will now be described.

In FIG. 2, showing the vacuum control valve 84 in FIG. 1 schematically, $P_A$ disignates a pressure in the first chamber 92 opened to the atmosphere through the hole 90 (FIG. 1), $P_B$ designates a pressure in the second chamber 96 connected to the exhaust manifold 22 via the tube 94, $P_C$ designates a pressure in the third chamber 104 connected to the carburetor port 102 (FIG. 1), and $P_D$ designates a pressure in the fourth chamber 108 opened to the atmosphere through the tube 112 (FIG. 1). The area of the diaphragm 86 is $S_1$, and the area of the diaphragm 88 is $S_2$ ($S_1 > S_2$). Considering the force balance between the diaphragms 86 and 88, the following equations are obtained.

$$S_1(P_B - P_A) = S_2(P_B - P_C)$$

Therefore $$P_C = P_B - S_1/S_2 \times (P_B - P_A) \quad (1)$$

If $P_B$ is expressed by a gauge pressure $P_B'$ and $P_c$ is expressed by a gauge pressure $P_C'$, the following equation is obtained.

$$P_C' = P_C - P_A = (1 - S_2/S_1)\, P_B' \quad (2)$$

This equation (2) indicates that the vacuum pressure $P_C'$ in the chamber 104 is increased in accordance with the exhaust gas pressure $P_B'$ (in other words, engine rotational speed), if $S_1 > S_2$. Therefore, the vacuum pressure in the compensation chamber 82 connected to the third chamber 104 through the tubes 105 and 98 is controlled so as to increase when the engine rotational speed is increased.

It should be noted that for introduction of air from the fourth chamber 108 to the third chamber 104 through the valve member 110 which is moved by the exhaust gas pressure $P_B$ in the exhaust manifold 22, the following equations should be satisfied.

$$S_2(P_B - P_C) \geqq S_1(P_B - P_A) \geqq S_2(P_B - P_A)$$

therefore $$1 \leqq (S_1/S_2) \leqq (P_B' - P_C'/P_B') \quad (3)$$

As is clear from the above, if the areas $S_1$ and $S_2$ of the diaphragms 86 and 88, and the dimension of the orifices 100 and 114 are adjusted suitably a vacuum pressure $P_C$, which increases in accordance with the engine rotational speed in accordance with the equation (2), is obtained by the vacuum control valve 84. Therefore, the vacuum advance control diaphragm 60 is moved back in the left hand direction of FIG. 1 during high speed engine operation by said vacuum pressure $P_C$ in the vacuum compensation chamber 82. This prevents the ignition timing during the operation from being too advanced and, thus, the required ignition timing is obtained.

While this invention is described in relation to a specific embodiment which utilizes the double diaphragm type vacuum advancer for the prupose of illustration, another type of vacuum advancer, for example a single diaphragm type may be used. Also, it should be apparent that numerous changes to the described embodiment could be made within spirit and scope of the invention.

What is claimed is:

1. In an apparatus for controlling the ignition timing of an internal combustion engine provided with an exhaust gas recirculation system, which apparatus comprises a distributor having a spark advance control shaft, at least one vacuum spark advance control diaphragm connected to said shaft, at least one vacuum advance control chamber which is formed on a side of said diaphragm, a port formed in the engine intake system, a pipe connecting said port to said chamber so that the chamber is subject to the engine vacuum to cause said shaft to be displaced to advance the ignition timing of the distributor in response to the level of the engine vacuum while the exhaust gas recirculation operation is functioning, the improvement wherein said apparatus further comprises: another port formed in the intake system of the engine, a vacuum advance compensation chamber formed on a side of said diaphragm of the vacuum advancer opposite to said vacuum advance control chamber, pipe means connecting said other port to said compensation chamber, and means for sensing intake and exhaust gas pressures, said sensing means being connected to the pipe means for controlling the vacuum level of said vacuum advance compensation chamber so as to prevent said advance shaft of the distributor from being too much displaced, whereby to cause the ignition timing to be delayed during operation at high engine speeds.

2. An apparatus according to claim 1, wherein said sensing means for controlling the vacuum level comprises: a casing; a first and a second diaphragm arranged across the interior of the casing, a first chamber which communicates with the atmosphere being formed on one side of the first diaphragm remote from the second diaphragm, a second chamber being formed between facing sides of the first and second diaphragms; a valve seat formed in the casing facing a side of the second diaphragm remote from the first diaphragm, a third chamber being formed between facing side of the second diaphragm and the valve seat, a fourth chamber being formed on a side of the valve seat remote from the second diaphragm; a rod connecting the first diaphragm with the second diaphragm, the rod extending to transverse direction of the diaphragms, and; a valve member secured on one end of the rod so as to face the valve seat; a first tube communicating the second chamber with a port formed in the exhaust system of the engine for opening the second chamber to the exhaust manifold; a second tube communicating said third chamber with the pipe means for opening the third chamber to the carburetor vacuum, and; a third tube communicating the fourth chamber with the atmosphere, whereby air is introduced into the third chamber from the fourth chamber through said valve member which is moved towards said valve seat in accordance with forces applied between the first and second diaphragms due to the exhaust gas pressure in the second chamber, so that the vacuum level in the third chamber is controlled in accordance with the exhaust gas pressure.

3. An apparatus according to claim 2, wherein said first tube includes therein an orifice for restricting introduction of a vacuum from the compensation port into said third chamber.

4. An apparatus according to claim 2, wherein said third tube includes therein another orifice for restricting introduction of the air from the atmosphere into the fourth chamber.

* * * * *